US006125505A

United States Patent [19]

Jensen et al.

[11] Patent Number: 6,125,505

[45] **Date of Patent: *Oct. 3, 2000**

[54] DOOR CLOSER AND MOUNTING BRACKET

[75] Inventors: James E. Jensen, Princeton; Andy Current, Oglesby, both of Ill.

[73] Assignee: Schlage Lock Company, San Francisco, Calif.

[ * ] Notice: This patent is subject to a terminal disclaimer.

[21] Appl. No.: 09/192,695

[22] Filed: Nov. 16, 1998

[51] Int. Cl.[7] ..... E05F 1/00

[52] U.S. Cl. ..... 16/71; 16/49; 16/51; 16/DIG. 40; 16/66; 248/200

[58] Field of Search ..... 16/71, 49, 84, 16/51, 66, 64, 82, 271, 382, DIG. 40, DIG. 43; 403/201; 248/200, 316.7, 229.16, 229.26, 231.81; 49/358, 137, 501; 411/461–464

[56] References Cited

U.S. PATENT DOCUMENTS

| | | | |
|---|---|---|---|
| 3,188,682 | 6/1965 | Check et al. | 16/49 |
| 3,630,560 | 12/1971 | Atkins et al. | 16/49 |
| 3,774,345 | 11/1973 | Cole et al. | 49/501 |
| 4,083,080 | 4/1978 | Miyazawa | 16/66 |
| 4,086,681 | 5/1978 | Nakanishi | 16/49 |
| 4,122,647 | 10/1978 | Kovar | 52/712 |
| 4,179,092 | 12/1979 | Miyazawa | 16/49 |
| 4,424,607 | 1/1984 | Langenhorst | 16/387 |
| 4,831,687 | 5/1989 | Lin et al. | 16/71 |
| 4,847,946 | 7/1989 | Nam et al. | 16/53 |
| 5,265,306 | 11/1993 | Yu | 16/51 |
| 5,357,725 | 10/1994 | Ferry | 16/222 |

FOREIGN PATENT DOCUMENTS

| | | | |
|---|---|---|---|
| 1 168 985 | 10/1969 | United Kingdom | E05F 3/00 |
| 2 002 446 | 2/1979 | United Kingdom | E05F 7/00 |

*Primary Examiner*—Chuck Y. Mah
*Attorney, Agent, or Firm*—Michael H. Minns

[57] ABSTRACT

A door closer and mounting bracket for attaching the door closer to either the door or the door frame. The door closer includes a lip at one end for engaging a corresponding hook on the mounting bracket and a screw passageway at the other end for engaging a screw on the mounting bracket. A unique mounting hole pattern is used to prevent installing the mounting bracket in the wrong orientation.

8 Claims, 3 Drawing Sheets

DOOR CLOSER AND MOUNTING BRACKET

BACKGROUND OF THE INVENTION

This invention relates generally to door closers and more particularly to mounting brackets for door closers.

Current state of the art door closers in the commercial market attach to the door or door frame using very similar methods. They all use fasteners to directly attach the door closer to the door or door frame. Current door closers typically stake the regulation screws into the door closer such that during speed adjustment the user can not remove the speed regulating screws. The staking requires an additional manufacturing process and, in the event a regulation screw needs to be removed, requires the screw holes to be reamed out in order to remove the regulation screws.

One problem with current door closers is that after the mounting holes are drilled into the door, the door closer must be held in place while the fasteners are inserted and tightened. A door closer can weigh as much as 8 to 10 pounds. This heavy weight must be supported while the fasteners are being tightened. This can make the installation difficult.

Another problem with current door closers, is that the typical use of a rectangular pattern for the mounting holes can lead to mounting the door closer upside down. Therefore requiring the door closer to be removed and re-installed in the correct orientation.

The foregoing illustrates limitations known to exist in present door closers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door closer having a lip at a first end thereof and a screw passageway at a second end thereof; and a mounting bracket adapted to be attached to one of a door surface or a door frame surface, the mounting bracket having a door closer engaging retaining member at a first end thereof, the door closer engaging retaining member engaging the door closer lip.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
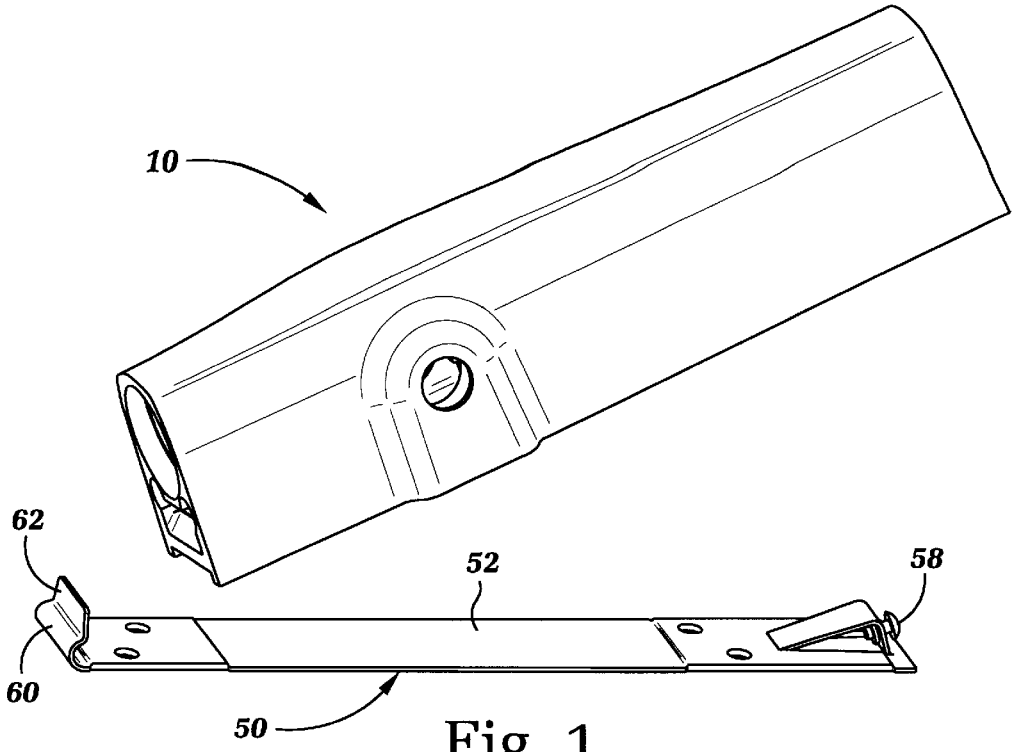
FIG. 1 is a perspective of a door closer and mounting bracket according to the present invention.
Figure 5:
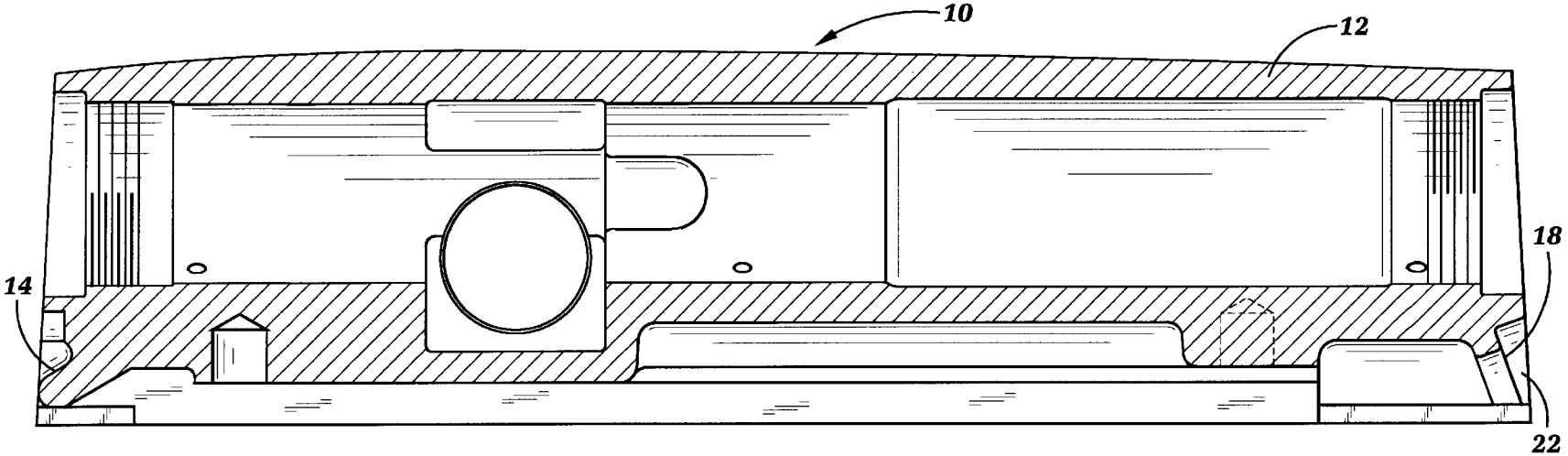
FIG. 5 is a longitudinal cross-sectional view of the door closer taken on line 5—5 of FIG. 4.
Figure 4:
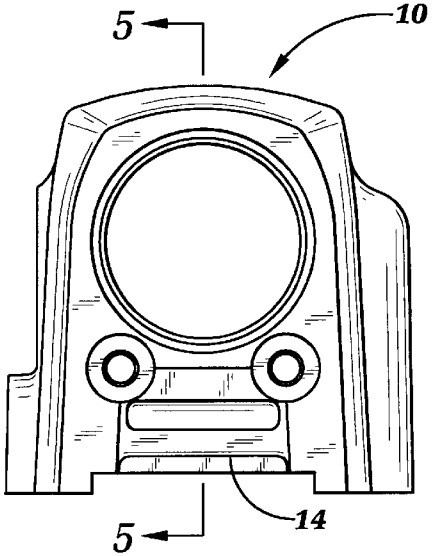
FIG. 4 is a left side view of the door closer shown in FIG. 1.
Figure 7:
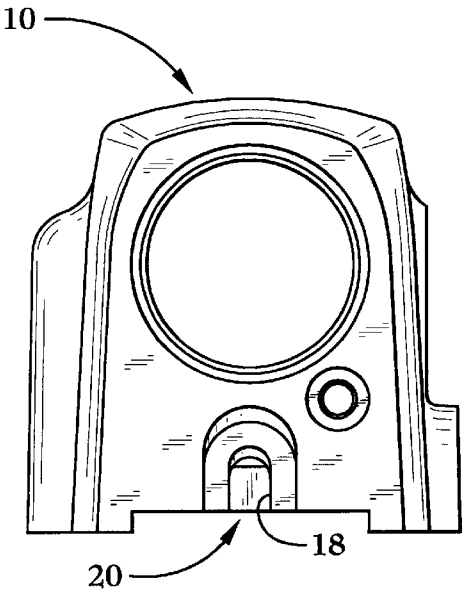
FIG. 7 is a right side view of the door closer shown in FIG. 1.

FIG. 1 shows the door closer 10 with a cylinder body 12 and its relationship to mounting bracket 50. One end the door closer 10 has a lip 14 (shown in FIGS. 4 and 5) which engages an angle clamp or hook portion 60 on one end of the mounting bracket 50. The other end of the door closer 10 includes a screw passageway 18 (shown in FIGS. 5 and 7) that engages the screw 58 on the mounting bracket 50. The screw 58 is threaded into a screw attachment 54. Preferably, the screw attachment 54 is angled (i.e., greater than 0° and less than 90°) such that when the screw 58 is tightened, the door closer 10 is pulled both towards the planar surface 52 of the mounting bracket and towards the hook 60. Also, preferably, the screw passageway 18 is open on one side (shown at 20 in FIG. 7) and has an angled surface 22 which is at a right angle to the screw 58 axis.

This door closer 10 and mounting bracket 50 design permits "hands free" installation of the door closer 10. First, the four holes for the mounting bracket 50 are drilled into either the door or the door frame. Then, the much lighter mounting bracket 50 is attached to the door or door frame using fasteners (not shown) inserted into mounting holes 70*a,* 70*b,* 74*a,* and 74*b.* The door closer lip 14 is inserted into the hook 60 and the other end of the door closer 10 is swung down onto the screw 58, as shown in FIG. 1 (the through slot 20 in screw passageway 18 permitting the door closer to be attached while the screw 58 is attached to screw attachment 54). The hook 60 and lip 14 in cooperation with the screw 58 and screw passageway 18 hold the door closer 10 loosely against the mounting bracket 50 until screw 58 can be turned to tightened the door closer 10 to the mounting bracket 50.

In an alternate and preferred installation method, the mounting bracket 50 is attached to the door or door frame using a plurality of self-tapping threaded fasteners that do not require any pre-drilled holes.

Figure 6:
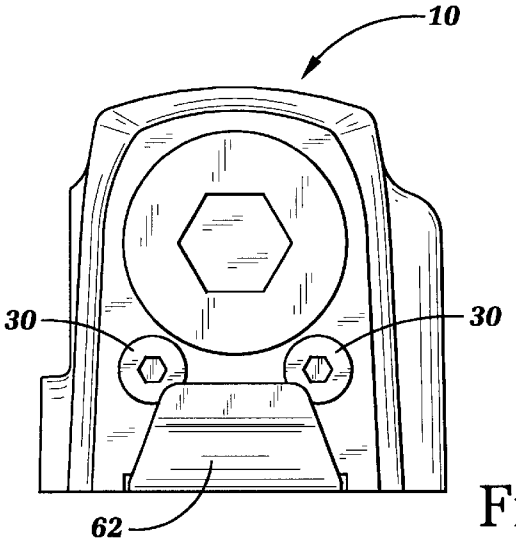
FIG. 6 is a left side view of the door closer and mounting bracket shown in FIG. 1 showing the door closer installed on the mounting bracket.

An additional feature of mounting bracket 50 is that it retains regulation screws 30 in the door closer 10. A regulation screw retainer 62 extends from the hook 60 to close proximity with the regulation screws 30, whereby, when the door closer 10 is attached to the mounting bracket 50, the regulation screw retainer 62 blocks removal of the regulation screws 30 from the door closer 10, as shown in FIG. 6.

Figure 2:
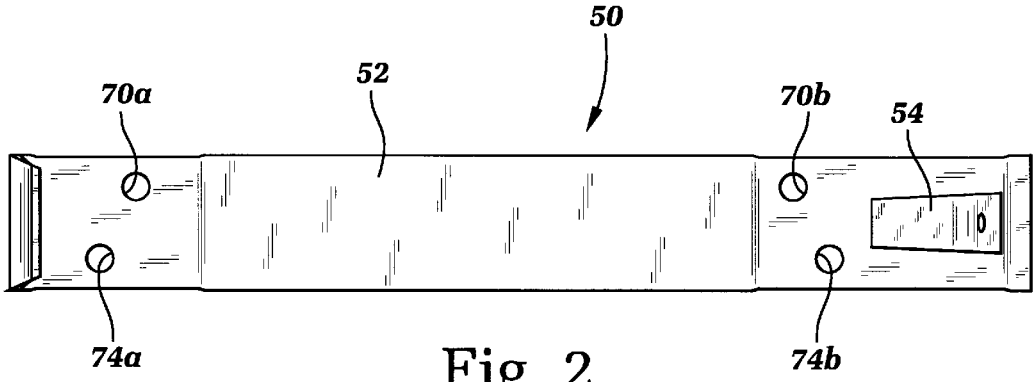
FIG. 2 is a top view of the mounting bracket shown in FIG. 1.
Figure 3:
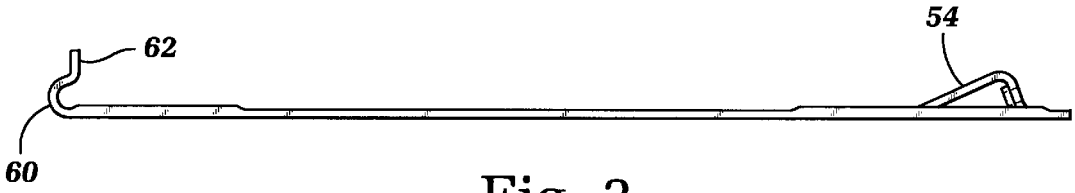
FIG. 3 is a side view of the mounting bracket shown in FIG. 1.

In its preferred embodiment, the mounting bracket 50 consists of a rectangular sheet like member 52 with the screw attachment 54 at one end and the hook 60 with regulation screw retainer 62 extending from the hook 60 at the other end (shown in FIGS. 2 and 3). The preferred mounting hole pattern is shown in FIG. 2. This mounting hole pattern permits only one orientation of the mounting bracket 50 after the mounting holes are drilled in the door or door frame. This hole pattern is characterized by a first pair of holes 70*a,* 70*b* being closer to one another than a second pair of holes 74*a,* 74*b* are to another and also by one of the first holes 70*a* being offset in a first direction from the corresponding, or adjacent, second hole 74*a* and the other of the first holes 70*b* being offset in a direction opposite to the first direction from the other of the second holes 74*b.*

Figure 8:
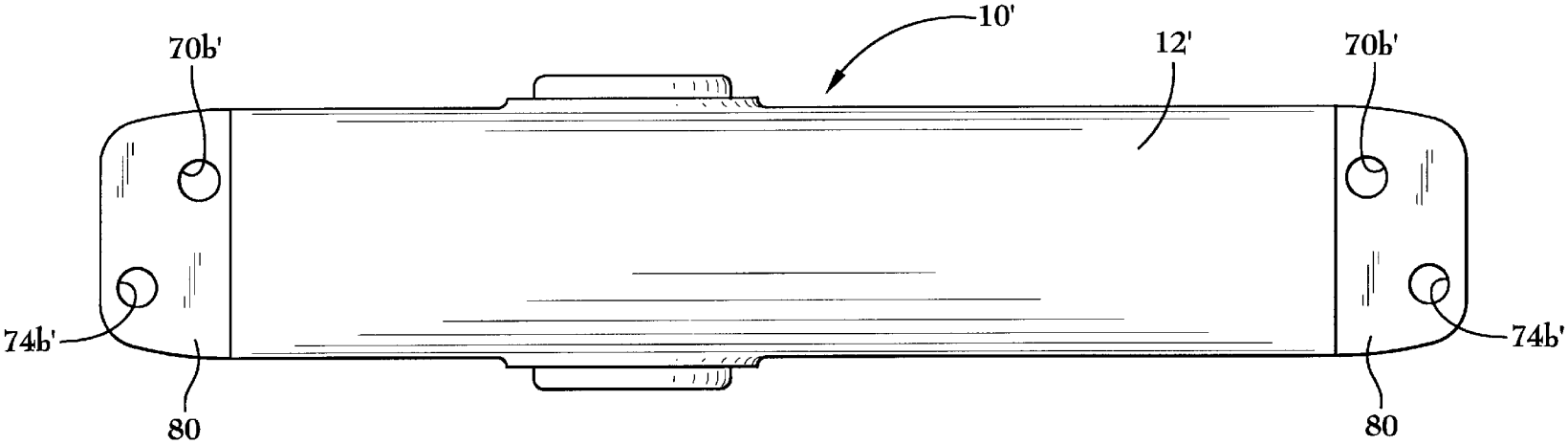
FIG. 8 is front view of an alternate embodiment of a door closer illustrating a novel mounting hole pattern.

An alternate embodiment of a door closer 10' with cylinder body 12' is shown in FIG. 8. For this alternate embodiment, no mounting bracket is used. From each end of the door closer 10', a foot portion 80 projects. The mounting hole pattern 70*a',* 70*b',* 74*a',* 70*b'* in the foot portion 80 is similar to that described above for the mounting bracket 50. Once the mounting holes are drilled into either the door or the door frame, the unique hole pattern 70*a'*, 70*b'*, 74*a'*, 70*b'* prevents the door closer 10' from being installed in an incorrect orientation.

Having described the invention, what is claimed is:

1. In combination:

a door closer having one lip formed in a first end thereof and a screw passageway at a second end thereof, the screw passageway including a means for permitting sideways passage of a shank of a screw into the screw passageway, the means for permitting sideways passage of a shank of a screw comprising a through slot in one side of the screw passageway; and a rectangular mounting bracket adapted to be attached to one of a door surface or a door frame, the rectangular mounting bracket having two long sides connected by two shorter ends, a first end of the rectangular mounting bracket being formed into a hook, the hook engaging the door closer lip, and having a screw attached distal the first end, a shank of the screw passing through the door closer screw passageway through slot when the door closer is being attached to the mounting bracket.

2. The combination according to claim 1, wherein the mounting bracket generally forms a planar surface and the screw axis extends at an angle greater than 0° and less than 90° to the mounting bracket planar surface.

3. The combination according to claim 2, wherein the screw passageway has a flat inclined screw head engaging surface, the angle of incline being 90° to the screw axis, an underside of a head of the screw engaging the flat inclined screw head engaging surface.

4. The combination according to claim 1, further comprising:

the door closer having at least one regulation screw at an end thereof; and the mounting bracket having a regulation screw retaining portion extending away from the hook, the regulation screw retaining portion extending proximate the at least one regulation screw whereby, when the door closer is attached to the mounting bracket, the regulation screw retaining portion blocks removal of the at least one regulation screw.

5. The combination according to claim 1, wherein the rectangular mounting bracket has a plurality of holes therein, the plurality of holes comprising two pairs of holes, a first pair of holes being adjacent to a first side of the mounting bracket, a second pair of holes being adjacent to a second side of the mounting bracket, the first pair of holes being closer to one another that the second pair of holes.

6. An improved door closer and rectangular mounting bracket, the improvement comprising:

one end of the rectangular mounting bracket being formed into a hook, a screw being attached distal the first end; and one lip formed in a first end of the door closer and a screw passageway being formed at the second end thereof, the screw passageway including means for permitting sideways passage of a shank of the screw into the screw passageway when the door closer is being attached to the mounting bracket, the means for permitting sideways passage of the shank of the screw comprising a through slot in one side of the screw passageway, the door closer lip engaging the mounting bracket hook.

7. The combination according to claim 6, wherein the mounting bracket generally forms a planar surface and the screw axis extends at an angle greater than 0° and less than 90° to the mounting bracket planar surface.

8. The combination according to claim 7, wherein the screw passageway has a flat inclined screw head engaging surface, the angle of incline being 90° to the screw axis, an underside of a head of the screw engaging the flat inclined screw head engaging surface.

* * * * *